United States Patent [19]

Taylor

[11] Patent Number: 4,822,178

[45] Date of Patent: Apr. 18, 1989

[54] BAG WITH DUAL PURPOSE HOOK AND LOOP FASTENER STRIPS AND METHOD OF MAKING SAME

[75] Inventor: Jeffrey L. Taylor, Cincinnati, Ohio

[73] Assignee: Standard Textile Company, Inc., Cincinnati, Ohio

[21] Appl. No.: 633,907

[22] Filed: Jul. 24, 1984

[51] Int. Cl.[4] ..... B65D 33/24

[52] U.S. Cl. ..... 383/33; 248/99; 383/35; 383/95; 493/214; 220/9.1

[58] Field of Search ..... 383/35, 95, 99, 33, 383/6; 248/97, 99, 101, 95; 24/31 V, 306; 150/49, 51; 493/213, 214

[56] References Cited

U.S. PATENT DOCUMENTS

| | | | |
|---|---|---|---|
| 1,910,789 | 5/1933 | Brady | 383/6 |
| 2,761,480 | 9/1956 | Tames | 383/6 X |
| 3,189,253 | 6/1965 | Mojonnier | 383/35 X |
| 3,275,053 | 9/1966 | Kabana | 383/95 X |
| 3,369,584 | 2/1968 | Faccio et al. | 383/95 X |
| 3,374,508 | 3/1968 | Slimovitz | 24/306 X |
| 3,610,560 | 10/1971 | Pillabough | 248/97 |
| 3,632,029 | 1/1972 | Sonner | 383/95 X |
| 3,831,650 | 8/1974 | Consorti | 248/99 X |
| 4,196,817 | 4/1980 | Moser | 383/95 X |
| 4,211,091 | 7/1980 | Campbell | 383/95 X |
| 4,268,067 | 5/1981 | Thomas | 24/31 V X |
| 4,308,642 | 1/1982 | Heyman | 24/306 |
| 4,308,672 | 1/1982 | Antonious | 24/306 X |
| 4,327,837 | 5/1982 | Ross | 24/31 V X |
| 4,417,612 | 11/1983 | Couture et al. | 383/95 X |

*Primary Examiner*—Stephen Marcus
*Assistant Examiner*—Bryon Gehman
*Attorney, Agent, or Firm*—Kinney & Schenk

[57] ABSTRACT

A bag for containing articles and method of making same are provided wherein such bag comprises a body portion having an access of a particular peripheral outline and a device for closing and opening the access, and the device comprises a hook and loop fastener for closing the entire extent of the peripheral outline with the fastener being adapted to be closed solely by urging a pair of cooperating portions thereof in pressure contact and being adapted to be opened by pulling the cooperating portions out of contact.

15 Claims, 3 Drawing Sheets

BAG WITH DUAL PURPOSE HOOK AND LOOP FASTENER STRIPS AND METHOD OF MAKING SAME

BACKGROUND OF THE INVENTION

1. Field of the Invention

This invention relates to a bag for containing articles, and more particularly, to a hamper bag for containing soiled linen articles in health care facilities or the like.

2. Prior Art Statement

Health care facilities including hospitals, nursing homes, and clinics usually collect soiled linen articles such as bed linens, towels of all types, drapes and like items used during surgery, articles of clothing worn by patients and health care professionals, and the like in so-called hamper bags which have a suitable access. Each of these bags is usually provided with means for closing same and heretofore draw strings, closure flaps, and the like have been used for this purpose. The bags proposed heretofore have often been comparatively difficult to close in a tight manner whereby there has been a tendency for bacteria permeated air to escape therefrom. In addition, such previously proposed bags have been comparatively difficult to open. Also, such hamper bags which are of the type used on hamper stands, are difficult to keep open on their hamper stands and also tend to slip off such stands. Accordingly, it is clear that hamper bags of the character mentioned have certain deficiencies.

SUMMARY OF THE INVENTION

This invention provides an improved bag for containing articles and particularly linen articles of the character mentioned wherein such bag overcomes the above-mentioned deficiencies; and, such bag comprises a body portion having an access of a particular peripheral outline and a device for closing and opening the access.

In accordance with one embodiment of this invention the device of such bag comprises a hook and loop fastener for closing the entire extent of the peripheral outline of the bag and the fastener is adapted to be closed solely by urging a pair of cooperating portions thereof in pressure contact and is adapted to be opened by pulling the cooperating portions out of pressure contact.

Accordingly, it is an object of this invention to provide an improved bag of the character mentioned for containing articles.

Another object of this invention is to provide an improved hamper bag of the character mentioned for containing articles wherein such bag is particularly adapted to be supported on a hamper stand.

Another object of this invention is to provide an improved method of making a bag of the character mentioned.

Other features, objects, uses, and advantages of this invention are apparent from a reading of this description which proceeds with reference to the accompanying drawings forming a part thereof.

BRIEF DESCRIPTION OF THE DRAWINGS

The accompanying drawings show present preferred embodiments of this invention, in which.

DETAILED DESCRIPTION

Figure 1:
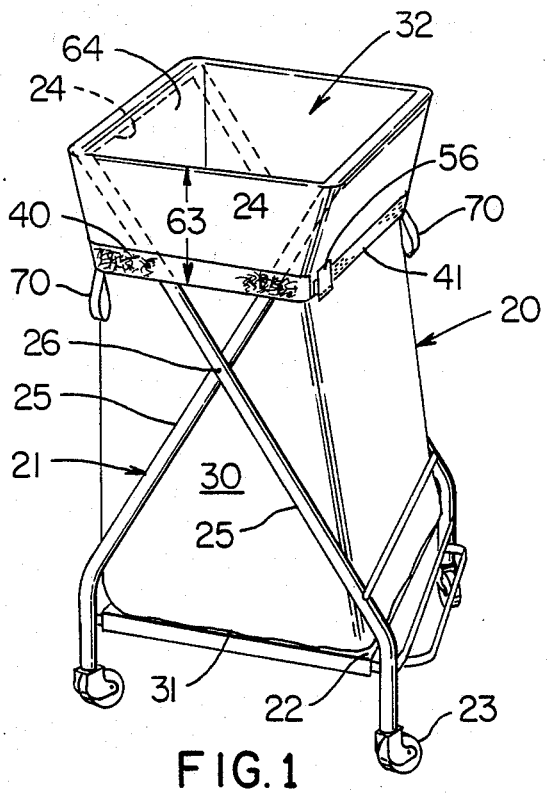
FIG. 1 is in isometric view illustrating the bag of this invention, in the form of a hamper bag, supported in an open position on an associated hamper stand.

Reference is now made to FIG. 1 of the drawings which illustrates one exemplary embodiment of the bag of this invention and such bag is designated generally by the reference numeral 20. The bag 20 is particularly adapted to contain articles such as soiled linen articles which may include bed linens, towels of all types, drapes and like items used during surgery, articles of clothing worn by patients and health care professionals, and the like.

The bag 20 is particularly adapted to be supported on a hamper stand and such hamper stand is designated generally by the reference numeral 21. The hamper stand 21 is of a folding type and has a shelf 22 supported on the lower portion thereof and has wheels 23 which enable easy movement of such hamper stand and bag 20 on a supporting floor. The stand 21 also has means in the form of upper end portions 24 thereof which are adapted to hold the bag 20 open and in a manner to be subsequently described.

The stand 21 is of a type known in the art and is comprised of two roughly U-shaped members each designated by the same reference numeral 25. The members 25 are pivotally connected by pivot pins 26 and the wheels 23 ar suitably installed in position in the tubular terminal ends of the roughly parallel legs of the U-shaped members and as is know in the art.

As illustrated in FIG. 1, the hamper stand 21 is of a foldable type. Accordingly, the self 22 is of a type which has one end detachably fastened to a U-shaped member 25 and its opposite end pivotally fastened to the other U-shaped member 25 whereby the shelf may be folded upwardly along the member 25 to which it is pivotally attached to enable folding of the entire hamper stand 21. A foldable hamper stand 21 is used merely for illustration, it being understood that triangular and round non-folding hamper stands could also be utilized with bag 20.

Figure 5:
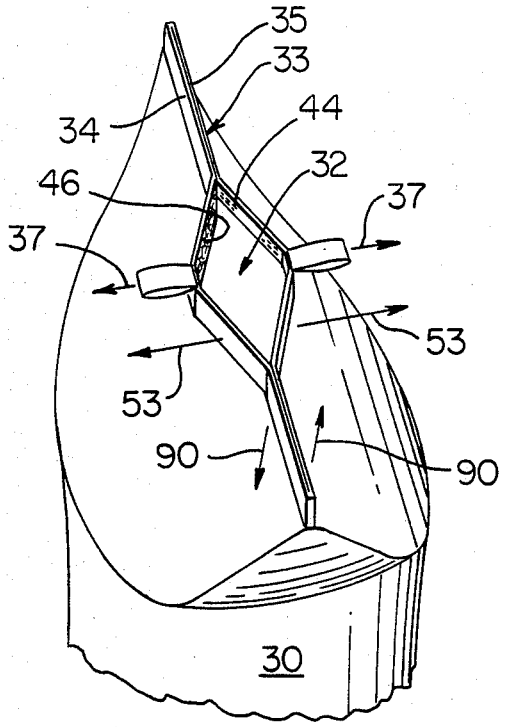
FIG. 5 is a fragmentary isometric view similar to FIG. 4 and illustrating the manner in which the closed fastener of FIG. 4 is opened.
Figure 6:
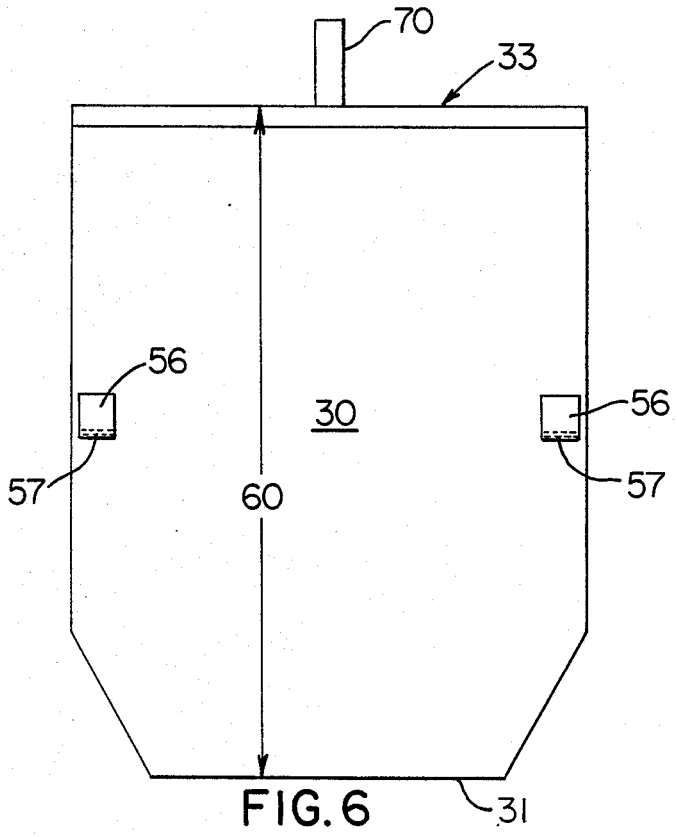
FIG. 6 is a view of the bag of FIG. 1 in an empty, flattened, and closed condition.
Figure 8:
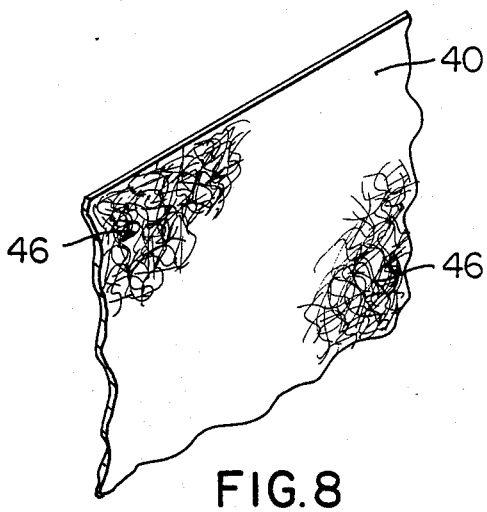
FIG. 8 is a view similar to FIG. 7 illustrating a part of the loop portion of the hook and loop fastener which comprises the device.

The bag 20 comprises a body portion 30 which has a closed end 31 as seen in FIGS. 1 and 6. The bag 20 has an access 32 (FIGS. 1 and 5) for articles to be disposed therein and removed therefrom. The access 32 is of a particular peripheral outline and indeed such access defines the entire peripheral outline of the open end of the bag 20. The access 32 has a device or fastener which is designated generally by the reference numeral 33 and is provided for closing and opening same.

The bag is adapted to be supported on the hamper stand 21, as previously mentioned, with the closed end 31 on the shelf 22 and the access 32 held open by portions 24 of the hamper stand 21 which define the means for holding such access open. The portions 24 define the bights of the U-shaped members.

Figure 4:
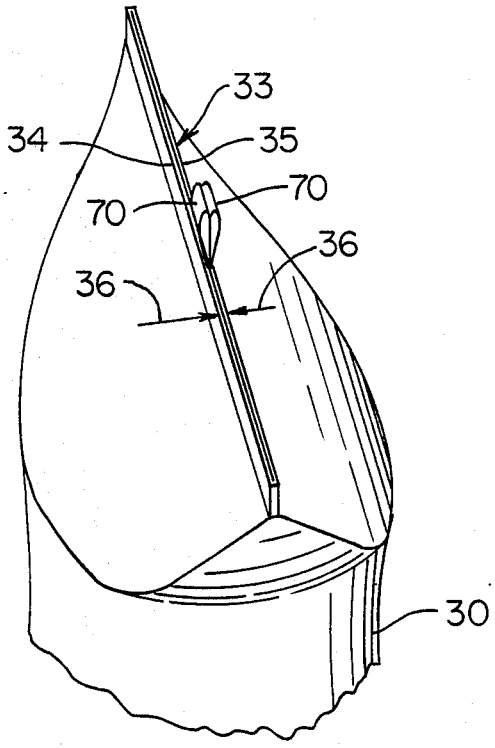
FIG. 4 is a fragmentary isometric view showing the bag of FIG. 1 removed from its hamper stand and illustrating a device for closing the access for such bag in its closed position.

In accordance with the teachings of this invention the device 33 is in the form of a hook and loop fastener 33 which is provided for closing the entire extent of the peripheral outline of the open end of the bag once such bag is removed from the stand 21. The fastener 33 is adapted to be closed solely by urging a pair of cooperating portions 34 and 35 thereof in pressure contact is indicated by the arrows 36 in FIG. 4 and is adapted to be opened by pulling such cooperating portions 34 and 35 out of contact and as indicated by the arrows 37 in FIG. 5.

Figure 9:
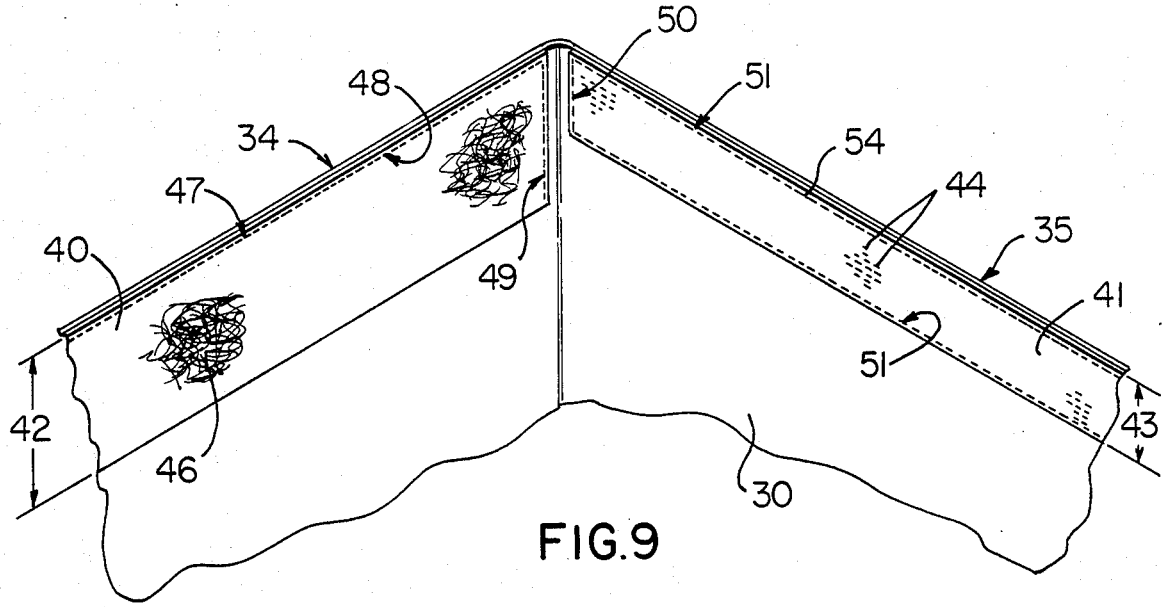
FIG. 9 is a fragmentary isometric view showing the bag of FIG. 1 open and showing the construction and arrangement of the hook and loop fastener as defined by a pair of substantially rectangular strips of equal length.
Figure 10:
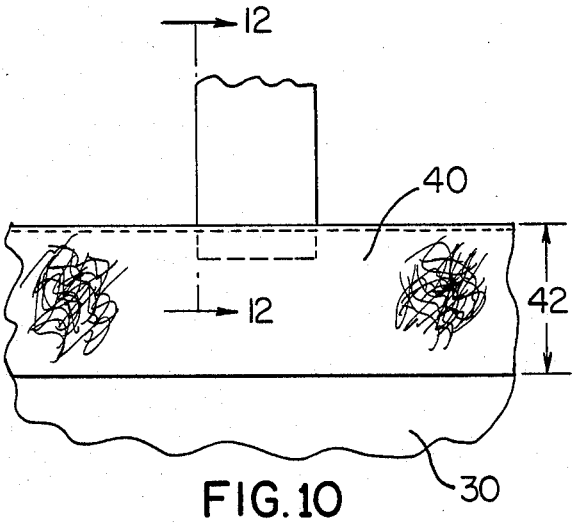
FIG. 10 is a fragmentary isometric view illustrating a pull member attached to the one strip which defines the loop portion of the fastener.
Figure 11:
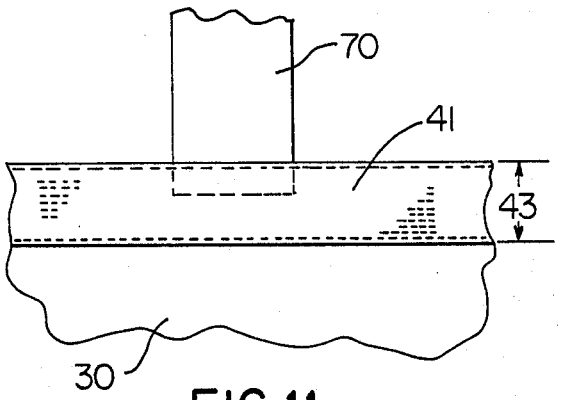
FIG. 11 is a view similar to FIG. 10 illustrating a pull member attached to the other strip which defines the hook portion of the strip.

The pair of cooperating portions 34 and 35 of fastener 33 comprise a pair of substantially rectangular strips 40 and 41 of equal length and each is fastened to the inside of the body portion 30 of bag 20 and extends along one-half of the peripheral outline of such body portion. One of the strips, shown as the strip 40 in this example, has a first width 42 as shown in FIG. 9 and the other 41 of such strips has a second width 43 which is less than the first width 42. The second width 43 enables the strip 41 to be easily urged against the strip 40 along the full length thereof to easily close the access even with misalignment of the strips. It will be appreciated that in closing the access 32 the strips 40–41 may tend to be misaligned along the length of the bag; however, even with such misalignment closure of the access 32 is assured because at least a part of the strip 41 will engage a part of the strip 40, even if the strips are disposed in a skewed manner to thereby provide the closing action.

Figure 7:
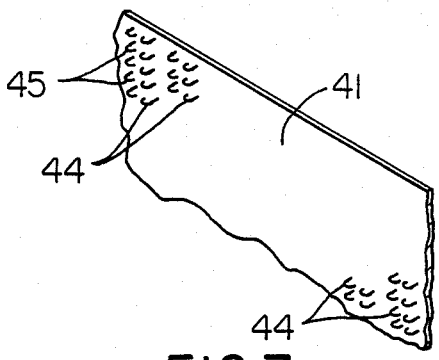
FIG. 7 is a fragmentary isometric view of a part of the hook portion of a hook and loop fastener which comprises the device for opening and closing the access of the bag of FIG. 1.

The hook and loop fastener 33 comprises a plurality of hook members each designated by the same reference numeral 44 and with only a few representative ones being thus designated in FIG. 7. The hook members 44 are roughly J-shaped members each having a leg terminating in an outer hooking end 45. The legs of members 44 are attached at their inner ends to their associated strip 41 in spaced relation and across the full width and length of such strip.

The hook and loop fastener also has a plurality of loop means defined as randomly disposed matted fibers 46 of comparatively short lengths which are suitably fastened to their associated strip 40 in random crossing patterns over the entire width and length of such strip. The fastening action is provided by the hooking ends 45 of the J-shaped members 44 being engaged and held by the matted fibers 46 to provide a holding or fastening action. Such action is well known whereby upon urging strips 40 and 41 together the matted fibers 46 engage the hooking ends 45 and hold the strips 40–41 together and thereby close the access 32. The access 32 is opened by pulling the strips 40–41 and hence the members 44 and 46 apart.

The bag 20 has means for attaching each of the strips 40 and 41 to the body portion as will now be described in detail. In particular it will be seen that such attaching means comprises stitch means or stitches 47, as shown in FIG. 9. The stitch means 47 serves to attach the rectangular strip 40 to the body portion 30 adjacent to and along the full extent of the outermost of its side edges as shown at 48 and adjacent to and along the full extent of both of its parallel end edges as shown typically at 49 for one end edge thereof. The strip 40 is thus attached to the body portion in a hinged manner.

The bag 20 also has means attaching the other rectangular strip 41 to the body portion 30 along the full extent of both of its parallel end edges, as shown typically at 50 for one of its end edges in FIG. 9, and adjacent to and along the full extent of both of its parallel side edges as shown at 51.

The attachment of strip 40 in the above-described hinged manner assures that pressure contact of the hook members 44 and the loop means 46 may be achieved across at least a portion of the width of each strip 40 and 41. It will be appreciated that without this hinged manner of attaching one strip 40 or 41 there might be a tendency for both strips 40–41 to remain flatly against their associated parts of the body portion 30 of the bag 20 whereby such strips could possibly be more easily disengaged especially when applying lateral forces or pressures substantially parallel 53 or perpendicular 90 to the planes of such strips 40–41 and as shown in FIG. 5, for example.

Figure 2:
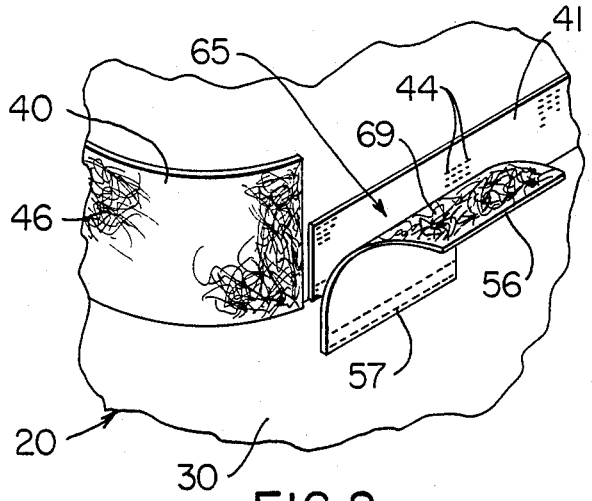
FIG. 2 is a fragmentary view of the central part of the upper central portion of the bag and illustrating one of a pair of tabs comprising the body portion of the bag folded outwardly and prior to engagement of such tab in position to hold the bag open on its hamper stand.

To hold the bag 20 with the access 32 fully open and thereby facilitate usage thereof on the hamper stand 21 in such open position, the bag has a pair of fastening tabs, each designated by the same reference numeral 56, attached to the body portion 30 as shown in FIG. 6. Each tab 56 is attached to such body portion using suitable stitch means or stitches 57; and the tabs 56 are attached in position at approximately diametrically opposed locations around the periphery of the body portion 30. The tabs 56 are attached in a hinged manner by the stitches 57 as will be readily apparent in FIG. 2 and this is achieved by providing tabs of roughly rectangular or square outline and attaching such tabs 56 using the stitch means 57 along one end such as lower end in this example thereof. In the illustration of FIG. 6 the bag 20 is shown in a flattened position and with the above description that the tabs 56 are attached to the body portion at approximately diametrically opposite positions around its periphery it will be noted that such tabs are disposed adjacent oppsosite side edges of the flattened bag 20.

Figure 3:
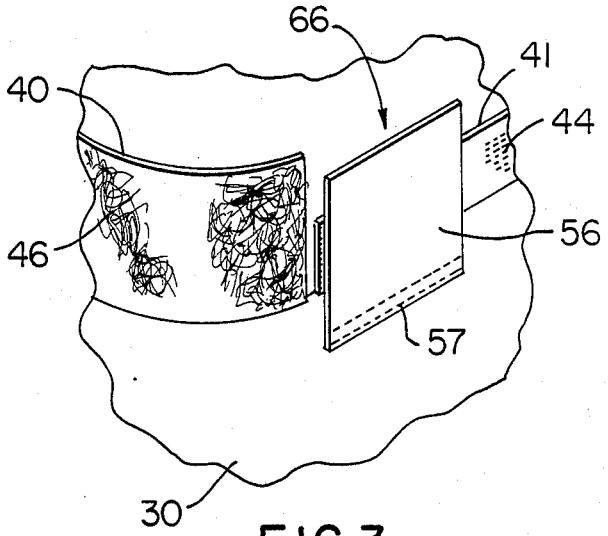
FIG. 3 is a view similar to FIG. 2 showing the tab in its fastened position and holding the outer end part of the body portion folded over a part adjacent the outer end part to thereby hold such bag open.

Each of the tabs 56 is also fastened in position or attached to the body portion 30 roughly midway along the axial length 60 of the body portion 30, as measured from its access toward it closed end. Further, each of the tabs 56 has cooperating means adapted to engage at least a portion of the fastening mat of the one strip 40 or certain ones of the hook members of the strip 41 so that with an outer end part 63 (FIG. 1) of the body portion 30 folded over the part 64 adjacent such outer end part the tabs 56 are adapted to hold the outer end part 63 thus folded. In this example of the invention the tabs 56 are provided with fastening mat portions, as shown at 69 in FIG. 2, which are adapted to engage certain ones of the hook members 44 of the strip 41 as shown at 65 in FIG. 2 so that once the tabs 56 are folded upwardly in position as shown at 66 in FIG. 3 the fastening mat portions 64 thereof engage members 44 and the outer end part 63 of the body portion is held in the folded position illustrated in FIG. 1.

Instead of the tab described above the fastening tabs 56 may be provided with hook members 44 and sewn by stitches 57 on the opposite side of the flattened bag of FIG. 6 and in the same relative positions as shown in FIG. 6 such that upon folding the outer end part of the body portion 30 as shown in FIG. 1 the tabs thus defined engage portions of the strip 40 to hold the bag 20 with its access 32 open.

Figure 12:
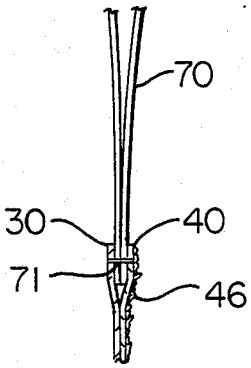
FIG. 12 is a view taken essentially on the line 12—12 of FIG. 10.

To facilitate the opening of access 32, the fastener 33 has a pair of pull members 70 midway along the length of the strips 40 and 41 thereof. The pull members 70 may be of any suitable type or configuration and in this example are substantially identical. A typical pull member 70 is illustrated in FIG. 12 and will now be described in detail.

In particular, each pull member 70 of this example is in the form of a U-shaped strap which is suitable fastened by stitches 71 to the body portion 30 of the bag 20. Each pull member or strap 70 is fastened in position by disposing its inner end edge between the body portion 30 and its strip. The member or strap 70 shown in FIG. 12 has its inner end sandwiched between the strip 40 and body portion 30 and is then fastened thereto by stitches 71. With the straps 70 thus fastened in position it is a simple matter to open the bag 30 simply by pulling outwardly on such straps 70 as shown in FIG. 5 and as indicated by the arrows 37 and in the manner previously described.

The bag 20 of this invention may be made of any suitable strong woven or knitted natural or synthetic material, such as, cotton, nylon, polyester (including blends thereof) or the like. However, due to the construction of bag 20 it is readily installed and held in position on the hamper stand 21. Further, even when making the bag 20 of a strong synthetic material which ordinarily results in the bag tending to slide off the stand 21, the unique features provided in such bag by this invention enable same to be held with its access 32 open yet with optimum simplicity.

As described earlier the fastener 33 of the bag 20 makes it easier to close and once closed the closure provided is a substantially tight closure which assures less escape of bacteria permeated air from the bag. Particularly in applications where soiled articles in the form of hospital linens or clothing worn by health care professionals are contained in the bag, the use of fastener 33 assures a substantially tight closing of such bag.

In this disclosure of the invention the fastener is described as being in the form of a hook and loop fastener for closing the entire extent of the peripheral outline of the bag. Although various types of fasteners may be utilized, one preferred type of fastener is made of a material sold uner the tradename VELCRO and is sold by Smalley & Bates, Inc., 220 Little Falls Road, Cedar Grove, N.J. 07009.

It has been found that by utilizing a VELCRO-type material for tabs 56 the bag is readily installed on stand 21. In addition, by using such material to define fastener 33 the access 32 may be efficiently opened and closed. Finally, a VELCRO type fastener has optimum durability and may be laundered repeatedly with its bag and it has been found that it has essentially the same life as the material comprising the bag 20 itself.

Terms such as sides, ends, bottom, top, and the like have been used in this disclosure to describe certain items as they are illustrated in the drawings. However, it is to be understood that these terms have been used for ease of description and presentation and should not be considered as limiting the scope of the claims in any way.

While present exemplary embodiments of this invention, and methods of practicing the same, have been illustrated and described, it will be recognized that this invention may be otherwise variously embodied and practiced within the scope of the following claims.

What is claimed is:

1. In a bag for containing articles and comprising a body portion having an access of a particular peripheral outline and a device for closing and opening said access, said device comprising a hook, and loop fastener for closing the entire extent of said peripheral outline, said fastener being adapted to be closed solely by urging a pair of cooperating portions thereof in pressure contact and being adapted to be opened by pulling said cooperating portions out of said contact, said cooperating portions of said fastener comprising a pair of cooperating substantially rectangular strips of substantially equal length each fastened to said body portion and extending along onehalf of said outline, one of said strips comprising a fastening mat having loop means and the other of said strips comprising a plurality of hook members which are adapted to engage and hook said loop means, the improvement comprising at least one tab attached to said body portion roughly midway along its length, said tab having cooperating hook members or loop means adapted to engage at least a portion of said loop means or hook members respectively of an associated strip so that with an outer end part of said body portion folded over a part of said body portion adjacent said outer end part said hook members or loop means of said tab are adapted to engage said portion of said loop means or hook members respectively of said associated strip and hold said outer end part of said body portion thus folded, said loop means or hook members of said associated strip thus being usable for the dual purpose of holding said access closed when cooperating with its cooperating strip and holding said outer end part in its folded over position when cooperating with hook members or loop means respectively of said tab.

2. A bag as set forth in claim 1 in which said one strip has a first width and the other of said strips has a second width which is less than said first width, and said second width enables said other strip to be easily urged against said one strip along the full length thereof to easily close said access even with misalignment of said strips.

3. A bag as set forth in claim 2 in which said fastening mat comprises said one width strip which has said first width and said hook members comprise said other strip which has said second width.

4. A bag as set forth in claim 3 and further comprising means attaching said other rectangular strip to said body portion adjacent to and along the full extent of both of its parallel side edges.

5. A bag as set forth in claim 4 and further comprising means attaching said one rectangular strip to said body portion adjacent to and along the full extent of the outermost of its parallel side edges and adjacent to and along the full extent of both of its parallel end edges, said one strip thus being attached in a hinged manner to assure pressure contact of said hook members and loop means may be achieved across at least a portion of the width of each strip.

6. A bag as set forth in claim 5 in which said means attaching said other rectangular strip comprises means attaching same along the full extent of both of its parallel end edges and said attaching means is in the form of stitch means.

7. In a bag for containing articles and comprising a body portion having an access of a particular peripheral outline and a device for closing and opening said access, said device comprising a hook and loop fastener for closing the entire extent of said peripheral outline, said fastener being adapted to be closed solely by urging a pair of cooperating portions thereof in pressure contact and being adapted to be opened by pulling said cooperating portions out of said contact, said cooperating portions of said fastener comprising a pair of cooperating substantially rectangular strips of substantially equal length each fastened to said body portion and extending along one-half of said outline, one of said strips comprising a fastening mat having loop means and the other of said strips comprising a plurality of hook members which are adapted to engage and hook said loop means, the improvement comprising, a pair of tabs attached to said body portion at approximately diametrically opposite positions around its periphery and roughly midway along its length, each of said tabs having hook members or loop means adapted to engage respectively at least portions of said loop means of said fastening mat of said one strip or certain ones of said hook members of said other strip so that with an outer end part of said body portion folded over a part adjacent said outer end part said tabs are adapted to hold said outer end part of said body portion thus folded, said portions of said loop means of said fastening mat of said one strip or said certain ones of said hook members of said other strip being useable for the dual purpose of holding said access closed when cooperating with mating components of its cooperating strip as well as holding said outer end part of said body portion in its folded over position when cooperating with hook members or loop means respectively of said tabs.

8. In a hamper bag for containing soiled clothing articles and comprising a body portion which has a closed end and an access for said articles, said access having a particular peripheral outline and having a device for closing and opening same; said bag being adapted to be supported on a hamper stand which has a shelf for supporting said closed end thereon and also has means for holding said access open; said device comprising a hook and loop fastener for closing the entire extent of said peripheral outline, said fastener being adapted to be closed solely by urging a pair of cooperating portions thereof in pressure contact and being adapted to be opened by pulling said cooperating portions out of said contact, said cooperating portions of said fastener comprising a pair of cooperating substantially rectangular strips of substantially equal length each fastened to said body portion and extending along one-half of said outline, one of said strips comprising a fastening mat having loop means and the other of said strips comprising a plurality of hook members which are adapted to engage and hook said loop means, the improvement comprising at least one tab attached to said body portion roughly midway along its length, said tab having cooperating hook members or loop means adapted to engage at least a portion of said loop means or hook members respectively of an associated strip so that with an outer end part of said body portion folded over a part of said body portion adjacent said outer end part said hook members or loop means of said tab are adapted to engage said portion of said loop means or hook members respectively of said associated strip and hold said outer end part of said body portion thus folded, said loop means or hook members of said associated strip thus being usable for the dual purpose of holding said access closed when cooperating with its cooperating strip and holding said outer end part in its folded over position when cooperating with hook members or loop means respectively of said tab.

9. A bag as set forth in claim 8 in which said one strip has a first width and the other of said strips has a second width which is less than said first width, and said second width enables said other strip to be easily urged against said one strip along the full length thereof to easily close said access even with misalignment of said strips.

10. A bag as set forth in claim 9 and further comprising means attaching said other rectangular strip to said body portion adjacent to and along the full extent of both of its parallel end edges, adjacent to and along the full extent of both of its parallel side edges.

11. A bag as set forth in claim 10 and further comprising means attaching said one rectangular strip to said body portion adjacent to and along the full extent of the outermost of its parallel side edges and adjacent to and along the full extent of both of its parallel end edges, said one strip thus being attached in a hinged manner to assure pressure contact of said hook members and loop means may be achieved across at least a portion of the width of each strip.

12. A bag as set forth in claim 11 in which said attaching means is in the form of stitch means.

13. In a method of making a bag for containing articles and comprising the steps of, forming a body portion, providing an access for said articles in said body portion, said access having a particular peripheral outline, and providing a device for closing and opening said access, said step of providing said device comprising providing a hook and loop fastener for closing and opening the entire extent of said peripheral outline, said fastener being adapted to be closed solely by urging a pair of cooperating portions thereof in pressure contact and being adapted to be opened by pulling said cooperating portions out of said contact, said step of providing said hook and loop fastener comprising providing said fastener having cooperating portions defined by a pair of cooperating substantially rectangular strips of substantially equal length each fastened to said body portion and extending along one-half of said outline, one of said strips comprising a fastening mat having loop means and the other of said strips comprising a plurality of hook members which are adapted to engage a hook said loop means, the improvement comprising the further step of, attaching at least one tab to said body portion roughly midway along its length, said tab having cooperating hook members or loop means adapted to engage at least a portion of said loop means or hook members respectively of an associated strip so that with an outer end part of said body portion folded over a part of said body portion adjacent said outer end part said hook members or loop means of said tab are adapted to engage said portion of said loop means or hook members respectively of said associated strip and hold said outer end part of said body portion thus folded, said loop means or hook members of said associated strip thus being usable for the dual purpose of holding said access closed when cooperating with its cooperating strip and holding said outer end part in its folded over position when cooperating with hook members or loop means respectively of said tab.

14. A method as set forth in claim 13 in which said step of providing said hook and loop fastener comprising providing said fastener having said cooperating portions defined by said pair of substantially rectangular strips of substantially equal length comprises providing said one strip having a first width and providing the other of said strips having a second width which is less than said first width, said second width enabling said other strip to be easily urged against said one strip along the full length thereof to easily close said access even with misalignment of said strips.

15. A method as set forth in claim 14 and further comprising the steps of, attaching said other rectangular strip to said body portion adjacent to and along the full extent of both of its parallel side edges and adjacent to and along the full extent of both of its parallel end edges, and attaching said one rectangular strip to said body portion adjacent to and along the full extent of both of its parallel end edges and adjacent to and along the full extent of the outermost of its parallel side edges, said one strip thus being attached in a hinged manner to assure pressure contact of said hook members and loop means may be achieved across at least a portion of the width of each strip.

* * * * *